US005899181A

United States Patent [19]

Kurata et al.

[11] Patent Number: 5,899,181

[45] Date of Patent: May 4, 1999

[54] VALVE TRAIN IN INTERNAL COMBUSTION ENGINE

[75] Inventors: Naoki Kurata, Okazaki; Masanori Sugiyama, Aichi-ken; Daichi Yamazaki, Toyota, all of Japan

[73] Assignee: Toyota Jidosha Kabushiki Kaisha, Toyota, Japan

[21] Appl. No.: 08/994,017

[22] Filed: Dec. 18, 1997

[30] Foreign Application Priority Data

Dec. 19, 1996 [JP] Japan ..... 8-339791

[51] Int. Cl.[6] ..... F01L 1/04; F02M 59/02

[52] U.S. Cl. ..... 123/90.17; 123/90.31; 123/90.6; 123/508

[58] Field of Search ..... 123/90.15, 90.17, 123/90.27, 90.31, 90.6, 467, 508, 509; 74/567

[56] References Cited

U.S. PATENT DOCUMENTS

| | | | |
|---|---|---|---|
| 4,942,854 | 7/1990 | Shirai et al. | 123/90.6 |
| 5,040,500 | 8/1991 | Reece | 123/90.6 |
| 5,107,805 | 4/1992 | Butterfield et al. | 123/90.17 |
| 5,603,303 | 2/1997 | Okajima et al. | 123/508 |
| 5,605,077 | 2/1997 | Tsunoda et al. | 74/567 |

FOREIGN PATENT DOCUMENTS

| | | |
|---|---|---|
| A-2 688 563 | 9/1993 | France . |
| A-64-73166 | 3/1989 | Japan . |
| A-2-146256 | 6/1990 | Japan . |
| U-7-22062 | 4/1995 | Japan . |
| A-7-332026 | 12/1995 | Japan . |

*Primary Examiner*—Weilun Lo
*Attorney, Agent, or Firm*—Oliff & Berridge, PLC

[57] ABSTRACT

A valve train for driving an engine valve in an internal combustion engine. A pump having a pressure chamber compresses and supplies fuel to the engine. An intake camshaft has valve cams for selectively opening and closing the intake valves and a pump cam for driving the pump. The intake camshaft has a torque fluctuation as a result of driving the intake valves and as a result of compressing fuel by the pump. A timing belt connects a crankshaft to the intake camshaft. The pump cam has a phase with respect to the intake camshaft to reduce a composite of the torque fluctuation (the net torque fluctuation) generated in the intake camshaft by the intake valves and the pump. This improves the life of the timing belt.

15 Claims, 14 Drawing Sheets

VALVE TRAIN IN INTERNAL COMBUSTION ENGINE

BACKGROUND OF THE INVENTION

The present invention relates to a valve train having a camshaft for actuating intake valves or exhaust valves in an internal combustion engine. More particularly, the present invention pertains to a valve train that actuates a fuel pump by rotation of a camshaft.

In a typical engine, rotational force of a crankshaft is transmitted to camshafts, for example, by a timing belt. The camshafts are rotated, accordingly. Valve cams on the camshafts selectively open and close intake valves and exhaust valves. Fuel injected from fuel injection valves is mixed with air. When the intake valves are opened, the air-fuel mixture is introduced to combustion chambers of the engine. The air-fuel mixture then fills the combustion chambers and is combusted. The combustion of the mixture generates power of the engine. After combustion, exhaust gas is discharged from the combustion chambers when the exhaust valves are opened.

In the above described engine, fuel is pressurized and is supplied to the fuel injection valve by a fuel injection pump. Several types of mechanisms for actuating the fuel injection pump have been proposed (see "Fuel Pump Actuating Mechanism in Engine" disclosed in Japanese Unexamined Utility Model Publication No. 7-22062). In a mechanism of this type, a pump cam is provided on a camshaft for actuating a fuel injection pump. The pump cam contacts a piston of the injection pump thereby converting rotation of the camshaft to reciprocation of the piston. The reciprocation of the piston introduces fuel from a fuel tank into a pressurizing chamber of the pump. The piston then pressurizes the fuel and supplies the fuel to the fuel injection valves.

The torque of a camshaft fluctuates when it selectively opens and closes intake valves or exhaust valves. The intake valves and the exhaust valves are constantly urged by valve springs in a closing direction. When the valves are opened against the force of the springs, torque opposite to the direction of rotating of the camshaft acts on the camshaft. On the other hand, when the valves are closed, torque in the rotating direction of the camshaft acts on the camshaft. These torques fluctuate the torque of the camshaft. Also, the inertia of each valve is another cause of the torque fluctuation in the camshaft.

A fuel injection pump, which is actuated by a camshaft, applies a reactive force on the camshaft. The magnitude of the reactive force during its suction stroke is different from the magnitude during its compression stroke. In other words, the magnitude of the reactive force fluctuates. Therefore, the torque of the camshaft is fluctuated not only by actuation of the intake or exhaust valves, but also by actuation of the fuel injection pump. When the torque fluctuation caused by the intake or exhaust valves and the torque fluctuation caused by the fuel injection pump overlap and are additive, the resultant torque fluctuation in the camshaft results in an excessive tension of the timing belt. This shortens the life of the belt.

Wide torque fluctuation of the camshaft causes the tension of the timing belt to also widely fluctuate. Wide tension fluctuation of the belt vibrates the belt and causes the belt to resonate. The resonance of the belt further increases the tension of the belt. This further shortens the life of the belt.

Some engines use a timing chain or gears to transmit rotational force of a crankshaft to camshafts. In these types of engines, torque fluctuation of camshafts increases the tension of the chain and the load on the teeth of the gears. This shortens the life of the chain or the gears.

Replacing the valve springs with springs having weaker force or changing the cam profile of the intake or exhaust cams will reduce the torque fluctuation of the camshaft caused by actuation of intake or exhaust valves. As a result, the tension of the timing belt will be decreased and resonation of the belt will be prevented. However, weaker valve springs and changed cam profiles degrade the performance (for example, the power) of the engine.

SUMMARY OF THE INVENTION

Accordingly, it is an objective of the present invention to extend the life of a transmission mechanism that transmits the rotational force of a crankshaft to camshafts.

To achieve the above objective, the present invention provides a valve train for driving an engine valve provided on a camshaft in an internal combustion engine, the valve train comprising: a crankshaft; a pump for supplying fuel in a reservoir to the engine, wherein the pump has a pressure chamber for compressing fuel; a valve cam provided on the camshaft for selectively opening and closing the engine valve, wherein the camshaft has a first torque fluctuation cycle that corresponds to the rotation of the crankshaft as a result of driving the engine valve; a pump cam provided on the camshaft for driving the pump, wherein the camshaft has a second torque fluctuation cycle that corresponds to the rotation of the crankshaft as a result of compressing fuel by the pump; and a transmission mechanism for transmitting the torque of the crankshaft to the camshaft; wherein the pump cam has a phase with respect to the camshaft to reduce a composite of the first and second torque fluctuations.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF PREFERRED EMBODIMENTS

A valve train according to a first embodiment of the present invention will now be described. The valve train is mounted in an in-line four cylinder type engine 11.

Figure 1:
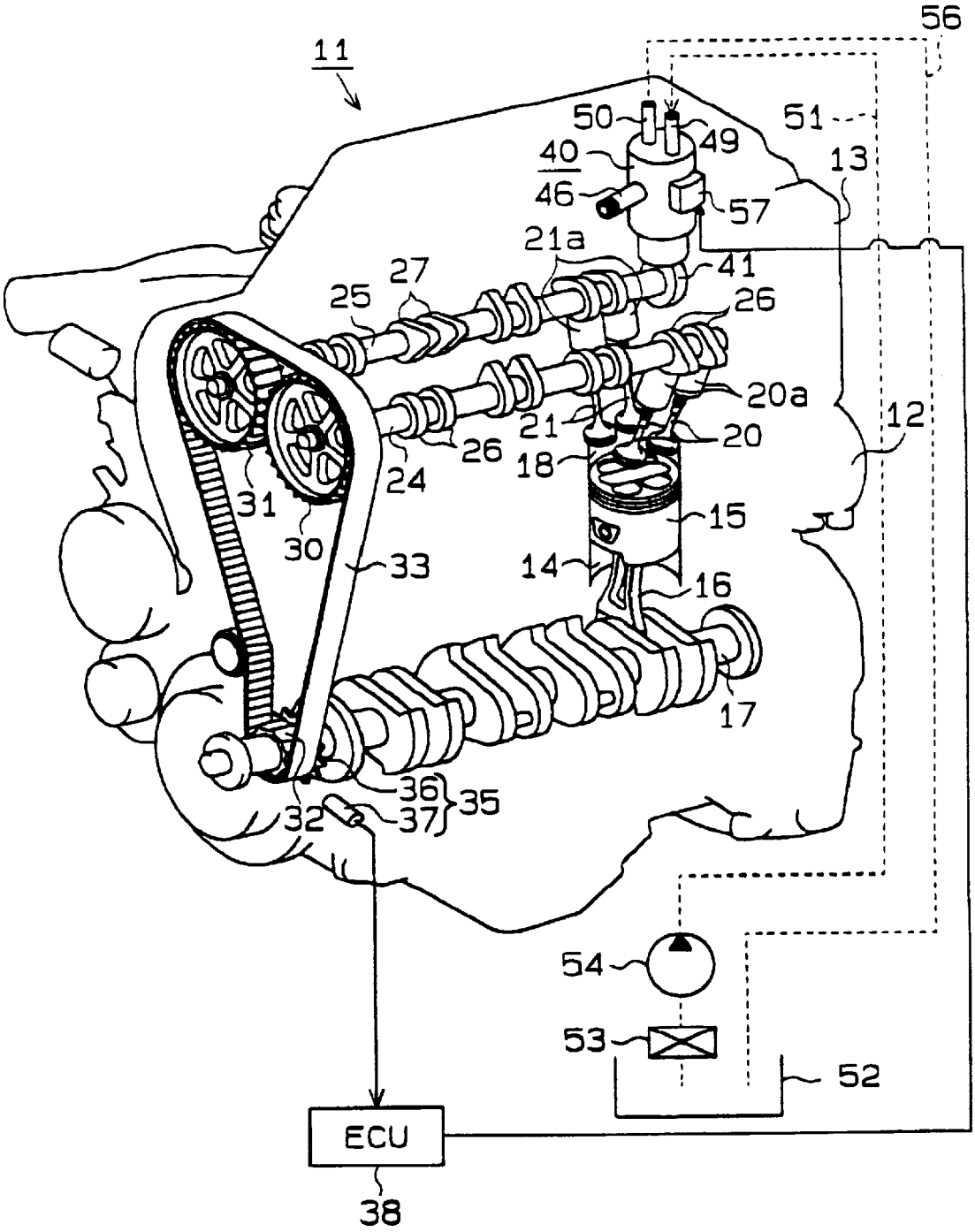
FIG. 1 is a partial perspective view illustrating an engine according to a first embodiment of the present invention.

As shown in FIG. 1, the engine 11 includes a cylinder block 12 and a cylinder head 13 secured to the top of the cylinder block 12. Four in-line cylinders 14 are defined in the cylinder block 12 (only one is shown). A piston 15 is reciprocally housed in each cylinder 14. Each piston 15 is coupled to a crankshaft 17 by a connecting rod 16.

In each cylinder 14, the piston 15 and the cylinder head 13 define a combustion chamber 18. The cylinder head 13 has ignition plugs (not shown), each of which corresponds to one of the cylinders 14. The ignition plugs are connected to a distributor (not shown). High voltage is applied to the ignition plugs by an ignitor (not shown) through the distributor.

The cylinder head 13 includes pairs of intake valves 20 and pairs of exhaust valves 21. One pair of intake valves 20 and one pair of exhaust valves 21 correspond to each one of the cylinders 14. Each combustion chamber 18 is communicated with a pair of intake ports and a pair of exhaust ports (neither of which is shown). The intake valves 20 and the exhaust valves 21 selectively open and close the intake ports and the exhaust ports, respectively. The cylinder head 13 is also provided with a fuel distribution pipe 22 (see FIG. 2). The distribution pipe 22 is connected with four fuel injection valves 23 (see FIG. 2), each of which corresponds to one of the cylinders 14. Fuel in the distribution pipe 22 is directly injected into the combustion chambers 18 through the fuel injection valves 23.

An intake camshaft 24 and an exhaust camshaft 25 are rotatably supported in the cylinder head 13. Pairs of valve cams 26 are located on the intake camshaft 24 with a predetermined interval between adjacent pairs. Similarly, pairs of valve cams 27 are located on the exhaust camshaft 25 with a predetermined interval between adjacent pairs. The valve cams 26 contact valve lifters 20*a* of the intake valves 20, whereas the valve cams 27 contact valve lifters 21*a* of the exhaust valves 21. Each of the valve lifters 20*a*, 21*a* has a valve spring (not shown) in it. The valve lifters 20*a*, 21*a* are urged toward the valve cams 26, 27 by the valve springs.

Cam pulleys 30, 31 are secured to an end (the left end as viewed in the drawing) of the camshafts 24, 25, respectively. A crank pulley 32 is secured to an end of the crankshaft 17. The pulleys 30–32 rotate integrally with the associated shaft 24, 25, 17. A timing belt 33 is wound about the cam pulleys 30, 31 and the crank pulley 32. The belt 33, the crank pulley 32 and the cam pulleys 30, 31 transmit rotational force of the crankshaft 17 to the camshafts 24, 25. One cycle of the engine 11, or four strokes (intake, compression, combustion and exhaust strokes) of each piston 15, rotates the crankshaft 17 two times (720° CA). Two turns of the crankshaft 17 rotate the camshafts 24, 25 once.

A crank angle sensor 35 is located on the crankshaft 17. The sensor 35 includes a rotor 36 made of magnetic material and an electromagnetic pickup 37. The rotor 36 is secured to the crankshaft 17 and has teeth on its circumference. The teeth are spaced apart at equal angular intervals. Every time one of the teeth passes by the pickup 37, the pickup 37 generates a pulse signal indicative of the crank angle.

The electromagnetic pickup 37 of the engine 11 is connected to an electronic control unit (ECU) 38. The pickup 37 outputs the crank angle signals to the ECU 38. The distributor has a cylinder distinguishing sensor (not shown) that detects a reference position on the crankshaft 17. The distinguishing sensor outputs a reference position signal to the ECU 38. The ECU 38 starts counting the number of crank angle signals from the crank angle sensor 35 after receiving a reference position signal and computes the rotational angle (crank angle θ) of the crankshaft 17.

The ECU 38 includes a random access memory (RAM), a read only memory (ROM) that stores various control programs, a central processing unit (CPU) that executes various computations (none of which is shown). The RAM, the ROM and the CPU are connected with one another by a bidirectional bus (not shown).

The cylinder head 13 is provided with a fuel injection pump 40 that supplies highly pressurized fuel to the fuel distribution pipe 22. An elliptic pump cam 41 is secured to an end (right end as viewed in FIG. 1) of the exhaust camshaft 25. The fuel injection pump 40 includes a pump lifter 42 (see FIG. 2). The pump lifter 42 contacts the pump cam 41.

Figure 2:
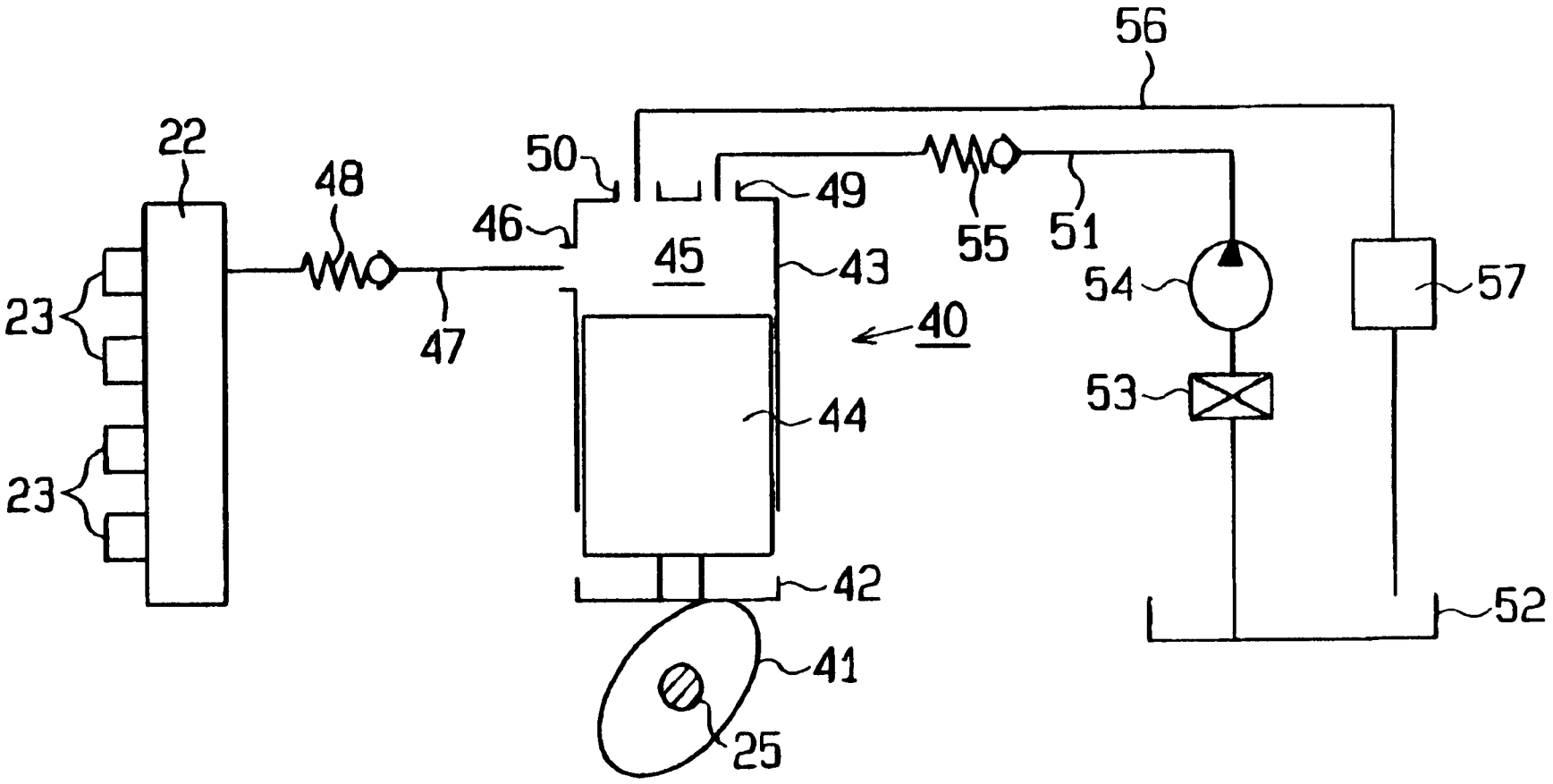
FIG. 2 is a diagram illustrating a system for supplying fuel to the engine of FIG. 1.

As shown in FIG. 2, the fuel injection pump 40 includes a cylinder 43. A plunger 44 is reciprocally housed in the cylinder 43. The pump lifter 42 is secured to the lower end of the plunger 44 and urged toward the pump cam 41 by a spring (not shown).

The wall of the cylinder 43 and the upper end face of the plunger 44 define a pressurizing chamber 45. A high pressure port 46 is communicated with the pressurizing chamber 45. The port 46 is connected to the fuel distribution pipe 22 by a high pressure fuel passage 47. A check valve 48 is located midway in the passage 47. The check valve 48 prevents fuel from flowing back to the pressurizing chamber 45 from the pipe 22.

Further, the cylinder 43 has a supply port 49 and a spill port 50, which are communicated with the pressurizing chamber 45. The supply port 49 is connected to a fuel tank 52 by a fuel supply passage 51. A fuel filter 53 and a feed pump 54 are located in the supply passage 51. Fuel stored in the fuel tank 52 is drawn by the feed pump 54 via the filter 53 and is supplied to the fuel pressurizing chamber 45 through the fuel supply passage 51. A check valve 55 is located in the passage 51 between the feed pump 54 and the chamber 45. The check valve 55 prevents fuel in the pressurizing chamber 45 from flowing back to the feed pump 54.

The spill port 50 is connected to the fuel tank 52 by a fuel spill passage 56. A spill valve 57 is located midway in the spill passage 56. The spill valve 57 is a normally open type electromagnetic valve and opens and closes based on energizing signals from the ECU 38. The valve 57 closes when inputting an ON signal from the ECU 38 and opens when current from the ECU 38 is stopped.

When the engine 11 is running, air is drawn into the combustion chamber 18 through the intake port as the intake valve 20 is opened. At the same time, the fuel injection valve 23 injects fuel into the combustion chamber 18. The air-fuel mixture is ignited by the ignition plug and combusted. This rotates the crankshaft 17. After combustion, exhaust gas is discharged to the outside through the exhaust port as the exhaust valve 21 is opened.

Rotation of the crankshaft 17 is transmitted to the camshafts 24, 25 by the timing belt 33 thereby rotating the camshafts 24, 25 and the valve cams 26, 27. Rotation of the valve cams 26, 27 actuates the valves 20, 21.

The pump cam 41 rotates integrally with the exhaust camshaft 25. Rotation of the cam 41 reciprocates the plunger 44 through the pump lifter 42. Reciprocation of the plunger 44 supplies highly pressurized fuel in the pressurizing chamber 45 to the distribution pipe 22 if the spill valve 57 is closed. Specifically, as the plunger 44 is lowered, fuel in the feed pump 54 is drawn into the chamber 45 through the supply passage 51. If the spill valve 57 is closed, lifting motion of the plunger 44 highly pressurizes the fuel in the chamber 45 and then supplies the fuel in the chamber 45 to the distribution pipe 22 through the passage 47. If the spill valve 57 is opened, on the other hand, lifting motion of the plunger 44 does not highly pressurize fuel in the chamber 45. Instead, the fuel in the chamber 45 is returned to the fuel tank 52 through the spill passage 56.

The ECU 38 changes the times at which the spill valve 57 is closed thereby controlling the amount of fuel supplied to the distribution pipe 22. Accordingly, the pressure of fuel in the pipe 22, or the fuel injection pressure of the injection valve 23, is controlled. In this embodiment, the pump cam 41 has an elliptic profile and thus includes two cam noses. Therefore, during two turns of the crankshaft 17, the injection pump 40 can pressurize fuel and supply the pressurized fuel to the pipe 22 two times.

In this embodiment, the phase of the pump cam 41 is optimal for reducing the tension of the timing belt 33. The phase of the pump cam 41 will now be described.

As described above, torque fluctuation is produced in the intake camshaft 24 when the shaft 24 actuates the intake valves 20. In the same manner, torque fluctuation is produced in the camshafts 25 when the shaft 25 actuates the exhaust valves 21. These torque fluctuations will hereinafter be referred to as valve actuating torque fluctuations. Also, the exhaust camshaft 25 has torque fluctuation produced when actuating the injection pump 40. This torque fluctuation will hereinafter be referred to as pump driving torque fluctuation. The pump driving torque fluctuation is produced only when the spill valve 57 is closed and fuel is being pressurized. The magnitude of the pump driving torque fluctuation varies in accordance with the lift of the pump lifter 42.

Figure 3:
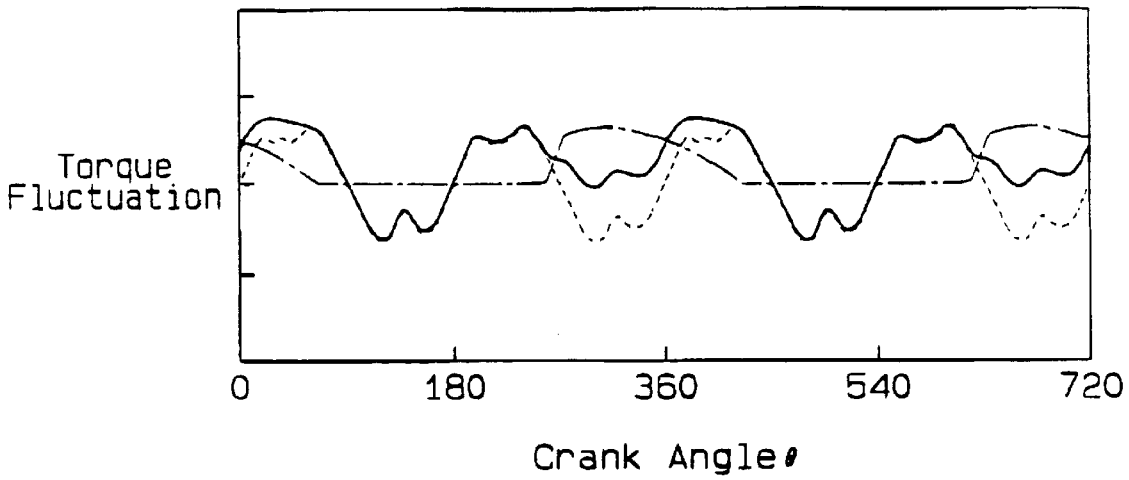
FIG. 3 is a graph showing the relationship between torque fluctuations and crank angle in the first embodiment.

The valve fluctuation torque fluctuations and the pump driving torque fluctuation change in relation to crank angle θ. In the graph of FIG. 3, the uniformly broken line represents a resultant of the valve actuating torque fluctuation of the intake camshaft 24 and the valve actuating torque fluctuation of the exhaust camshaft 25. This resultant fluctuation will hereinafter be referred to as valve train torque fluctuation. The dashed line having long and short segments represents pump driving torque fluctuation produced in the exhaust camshaft 25. The continuous line represents the resultant of the valve train torque fluctuation and the pump driving torque fluctuation. The fluctuation represented by the continuous line will hereafter be referred to as a total torque fluctuation.

As shown in FIG. 3, the same waveform is repeated two times in the valve train torque fluctuation during two turns of the camshaft 17. Also, since the pump cam 41 has two cam noses, the same waveform is repeated two times in the pump driving torque fluctuation during two turns of the crankshaft 17. In the period represented in FIG. 3, the spill valve 57 is closed and the fuel injection pump 40 repeatedly pressurizes fuel.

Figure 4:
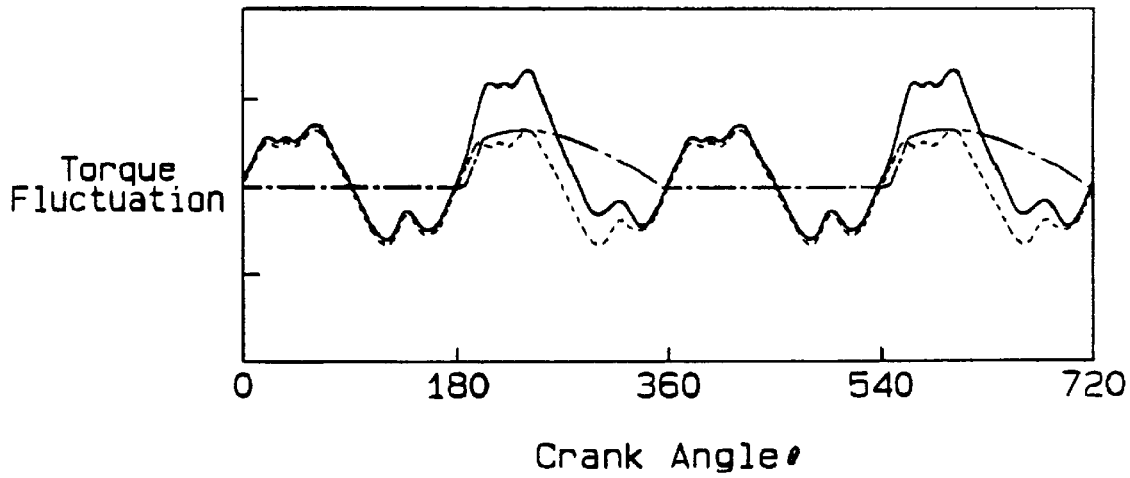
FIG. 4 is a graph showing the relationship between torque fluctuations and crank angle in a comparison example.

FIG. 4 shows a comparison graph of the same characteristics from a prior art engine in which peak values of the valve train torque fluctuation and the pump driving torque fluctuation occur at the same crank angle θ. As in FIG. 3, the uniformly broken line, the long and short dashed line and the continuous line in FIG. 4 represent the valve train torque fluctuation, the pump driving torque fluctuation and the total torque fluctuation, respectively. In this case, peaks of the total torque fluctuation have greater values compared to the total torque fluctuation peaks of FIG. 3. The amplitude of the total torque fluctuation of the prior art engine of FIG. 4 is greater. The increased peak values of the total torque fluctuation increase the maximum tension of the timing belt 33. This shortens the life of the belt 33.

Further, the greater amplitude of the total torque fluctuation results in increased tension fluctuation of the timing belt 33. The increased tension fluctuation of the belt 33 vibrates the belt 33 and causes resonance. The resonance further increases the maximum tension of the timing belt 33. This further shortens the life of the belt 33.

Contrarily, in the embodiment represented by the graph of FIG. 3, the phase of the pump cam 41, or the relative locations of the cam noses, is such that the maximum values of the pump driving torque fluctuation (the long and short dashed line) substantially overlaps the minimum values of the valve train torque fluctuation (the uniformly broken line). Therefore, to some degree, the pump driving torque fluctuation counteracts the valve train torque fluctuation. Thus, the total torque fluctuation in this embodiment, as represented by FIG. 3, has smaller maximum values and a lower amplitude than the prior art comparison example of FIG. 4. It was confirmed experimentally that this embodiment reduces the maximum tension of the belt 33 by approximately 20% compared to the prior art comparison example. As a result, the maximum tension of the timing belt 33 is reduced. This extends the life of the belt 33. Further, since this embodiment reduces the amplitude of the tension fluctuation of the belt 33, resonance in the belt 33 is prevented. Therefore, the tension of the belt 33 is not increased by resonance. As a result, the life of the timing belt 33 is further extended.

This embodiment requires no changes in the force of the valve springs and in the cam profile of the valve cams 26, 27. Therefore, the life of the timing belt 33 is extended without lowering the power characteristics of the engine 11.

A second embodiment of the present invention will now be described. In this embodiment, the present invention is embodied in a six-cylinder V-type engine 11.

Figure 5:
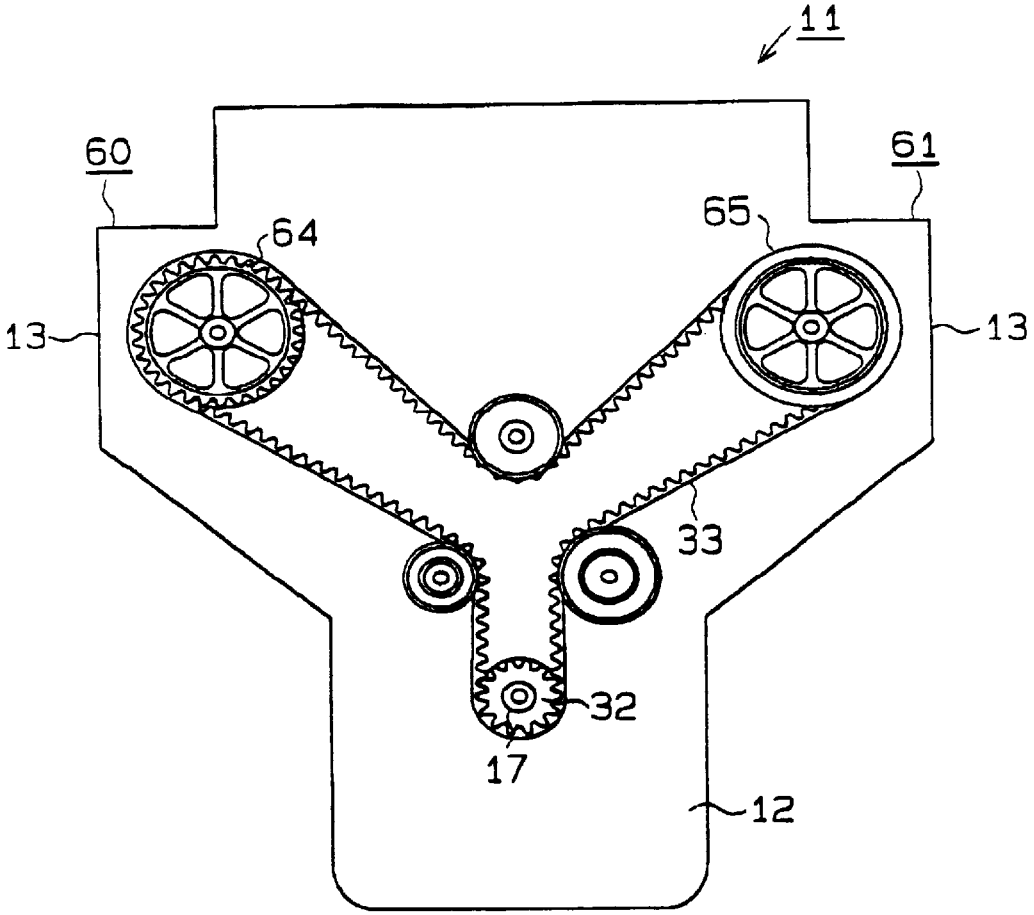
FIG. 5 is a side view illustrating an engine according to a second embodiment of the present invention.

As shown in FIG. 5, the engine 11 has a left bank 60 and a right bank 61, which are angularly spaced apart by 90 degrees about a crankshaft 17. Each of the banks 60, 61 has three cylinders (not shown) defined therein.

Figure 7:
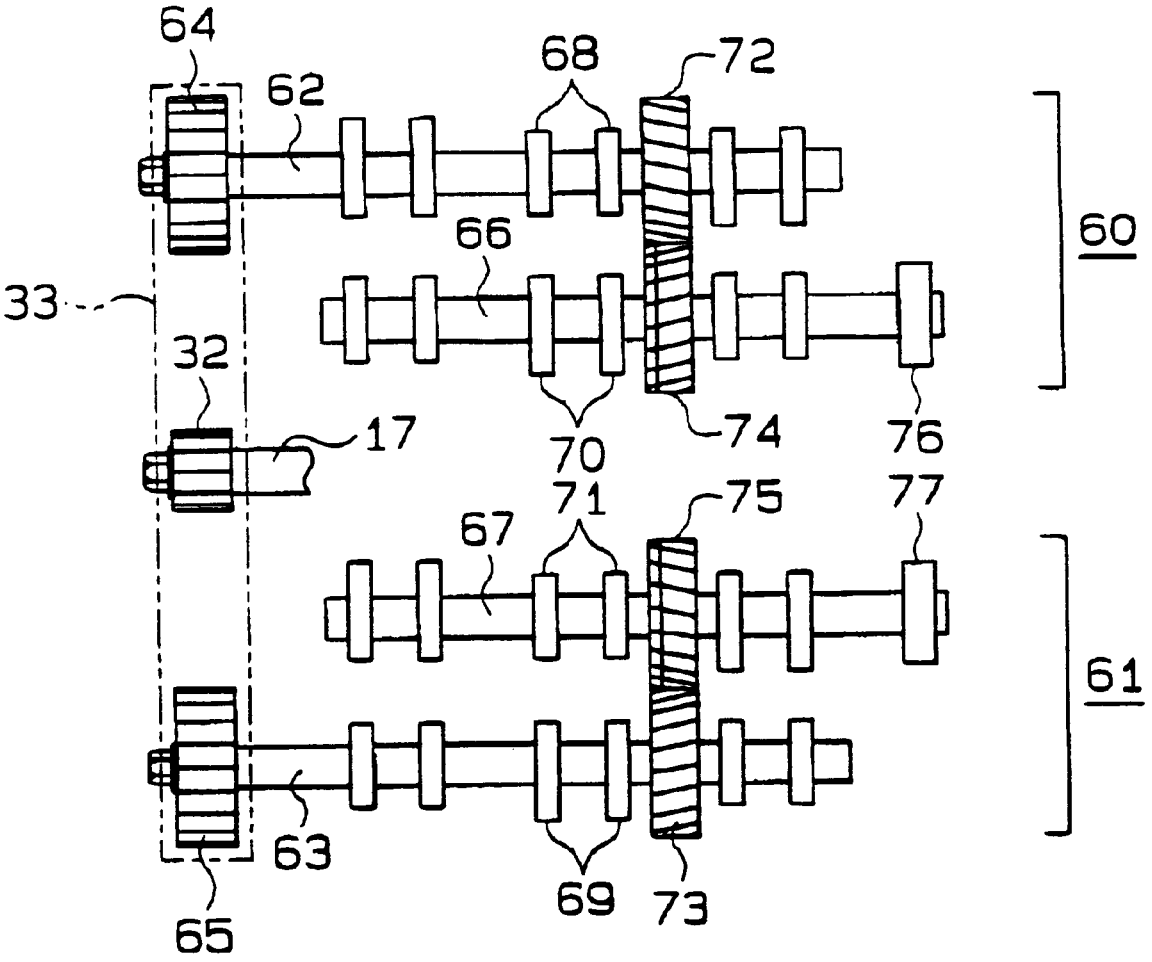
FIG. 7 is a diagram illustrating a valve train according to the second embodiment.

Each of the banks 60, 61 includes a cylinder head 13. As shown in FIG. 7, intake camshafts 62, 63 are rotatably supported in the cylinder heads 13 of the banks 60, 61. Cam pulleys 64, 65 are secured to ends (left ends as viewed in FIG. 7) of the intake camshafts 62, 63. As illustrated in FIGS. 5 and 7, a timing belt 33 is wound about the cam pulleys 64, 65 and a crank pulley 32, which is secured to the crankshaft 17.

The banks 60, 61 also have exhaust camshafts 66, 67, respectively. The exhaust camshafts 66, 67 are parallel to the intake camshafts 62, 63 and rotatably supported in the cylinder heads 13 of the banks 60, 61. Three pairs of valve cams 68, 69 are located on the intake camshafts 62, 63, respectively, with a predetermined interval between adjacent pairs. Similarly, three pairs of valve cams 70, 71 are located on the exhaust camshaft 66, 67, respectively, with a predetermined internal between adjacent pairs.

The intake camshafts 62, 63 include driver gears 72, 73 respectively. Also, the exhaust camshafts 66, 67 include driven gears 74, 75, respectively. The driven gears 74, 75 are scissors gears and are meshed with the driver gears 72, 73, respectively. The driver gears 72, 73 and the driven gears 74, 75 are helical gears having teeth that are not parallel to the axis of the shafts but are spiraled around the shafts. Rotational force of the crankshaft 17 is transmitted to the intake camshafts 62, 63 by the timing belt 33 and the cam pulleys 64, 65. Rotational force of the intake camshafts 62, 63 is then transmitted to the exhaust camshafts 66, 67 by the driver gears 72, 73 and the driven gears 74, 75.

The cylinder head 13 includes a fuel distribution pipe. Each distribution pipe is connected to fuel injection valves (not shown). Each cylinder head 13 further has a fuel injection pump (not shown) having the same construction as that in the first embodiment. The engine 11 also includes a pair of spill valves for controlling the amount of fuel injected from the fuel injection pumps. The fuel injection pumps and the spill valves have the same construction as those in the first embodiment.

Figure 6:
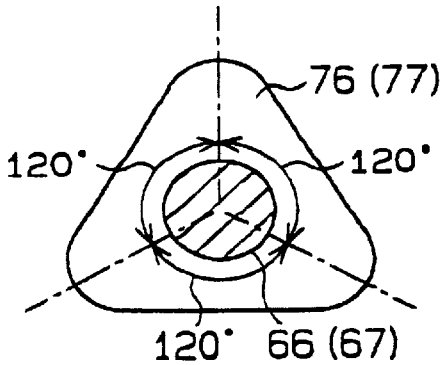
FIG. 6 is a cross-sectional view showing the profile of a pump cam.

Pump cams 76, 77 are located on the exhaust camshafts 66, 67, respectively, for actuating the injection pumps. As shown in FIG. 6, the pump cams 76, 77 have three cam noses. The cam noses angularly spaced apart by 120 degrees about the axis of the exhaust camshafts 66, 67. Therefore, while crankshaft 17 rotates two times, the injection pumps can pressurize fuel three times.

Figure 8A:
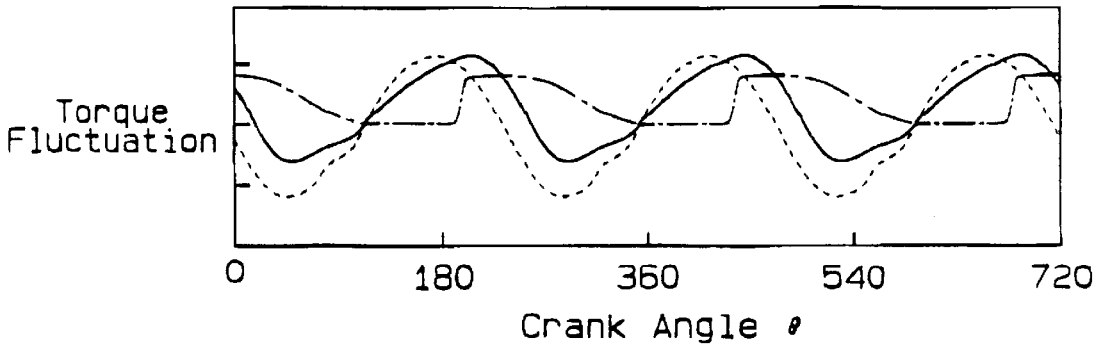
FIGS. 8(*a*), 8(*b*) and 8(*c*) are graphs showing the relationships between torque fluctuations and crank angle in the second embodiment.
Figure 8B:
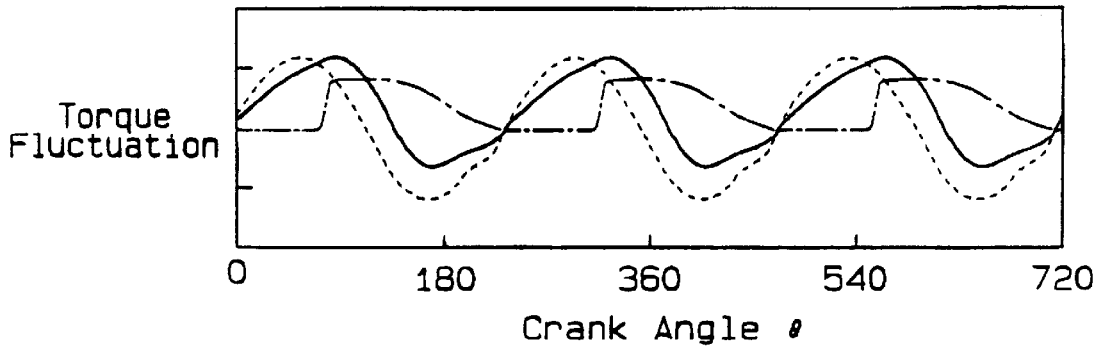
Figure 8C:
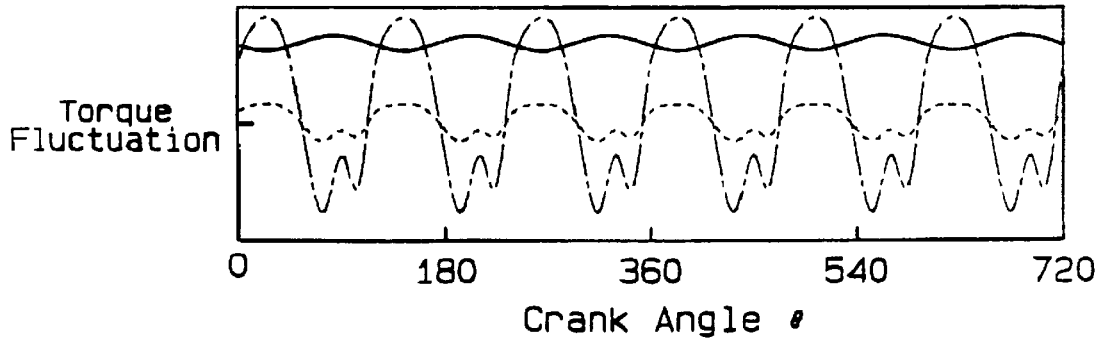

FIG. 8(*a*) is a graph showing torque fluctuation in the right bank 61 in relation to the crank angle θ. The uniformly broken line represents the valve train torque fluctuation (the resultant of valve actuating torque fluctuations in the intake camshaft 62 and the exhaust camshaft 67). The long and short dashed line represents the pump driving torque fluctuation. The continuous line represents the total torque fluctuation in the bank 61. Similarly, in FIG. 8(*b*), the uniformly broken line, the long and short dashed line and the continuous line represent the valve train torque fluctuation, pump driving torque fluctuation and the total torque fluctuation in the left bank 60, respectively.

As described above, each of the intake camshafts 62, 63 and the exhaust camshafts 66, 67 has three pairs of cams. In this engine 11, the same waveform is repeated three times in the valve train torque fluctuation during two turns of the crankshaft 17 as shown in FIGS. 8(*a*) and 8(*b*). Also, since the pump cams 76, 77 have three cam noses, the same waveform is repeated three times in the pump driving torque fluctuation during two turns of the crankshaft 17.

As illustrated in FIGS. 8(*a*) and 8(*b*), the phases of the pump cams 76, 77, or the relative locations of the cam noses, are determined such that greater values of the pump driving torque fluctuations (the long and short dashed lines in FIGS. 8(*a*) and 8(*b*)) substantially overlap smaller values of the valve train torque fluctuations (the uniformly broken lines in FIGS. 8(*a*) and 8(*b*)). Therefore, to a degree, the pump driving torque fluctuations counteract the valve train torque fluctuations.

In the graph of FIG. 8(*c*), the resultant of the valve train torque fluctuations in the banks 60, 61 is represented by the uniformly broken line and the resultant of the total torque fluctuations in the banks 60, 61 is represented by the continuous line.

Also, in the graph of FIG. 8(*c*), the dashed line represents the total torque fluctuation of a prior art V-8 engine used for comparison. In the example of FIGS. 5–8, the phases of the pump cams 76, 77 are such that greater values of the pump driving torque fluctuations in the banks 60, 61 substantially overlap greater values of the valve train torque fluctuations in the banks 60, 61.

As shown in FIG. 8(*c*), the resultant (the continuous line) of the total torque fluctuations in the banks 60, 61 (continuous lines in FIGS. 8(*a*) and 8(*b*)) according to this embodiment has smaller maximum values and a lower amplitude than the comparison example (the long and short dashed line in FIG. 8(*c*)). Therefore, as in the first embodiment, the maximum tension of the timing belt 33 is decreased. Further, this embodiment reduces the amplitude of the tension fluctuation of the belt 33. As a result, the life of the belt 33 is extended.

Further, the intake camshafts 62, 63 are coupled to the exhaust camshaft 66, 67 by the helical driver gears 72, 73 and the driven gears 74, 75. Therefore torque fluctuations in the camshafts 62, 63, 66, 67 vibrate the camshafts 62, 63, 66, 67 in their axial direction. The vibrations of the camshafts 62, 63, 66, 67 wear bearings that support the camshafts 62, 63, 66, 67.

However, since this embodiment suppresses torque fluctuations in the camshafts 62, 63, 66, 67, the vibrations of the camshafts 62, 63, 66, 67 in their axial direction are suppressed, accordingly. This prevents the bearing from being worn by the vibrations of the camshafts 62, 63, 66, 67.

Also, suppressing the axial vibrations of the camshafts 62, 63, 66, 67 reduces noise produced by the driver gears 72, 73 and the driven gears 74, 75 and the load acting on the teeth of the gears 72–75.

A further embodiment of the present invention will now be described. In this embodiment, the present invention is embodied in an in-line six cylinder type engine 11.

The differences from the first embodiment will mainly be discussed below, and like or the same reference numerals are given to those components that are like or the same as the corresponding components of the first embodiment.

Figure 9:
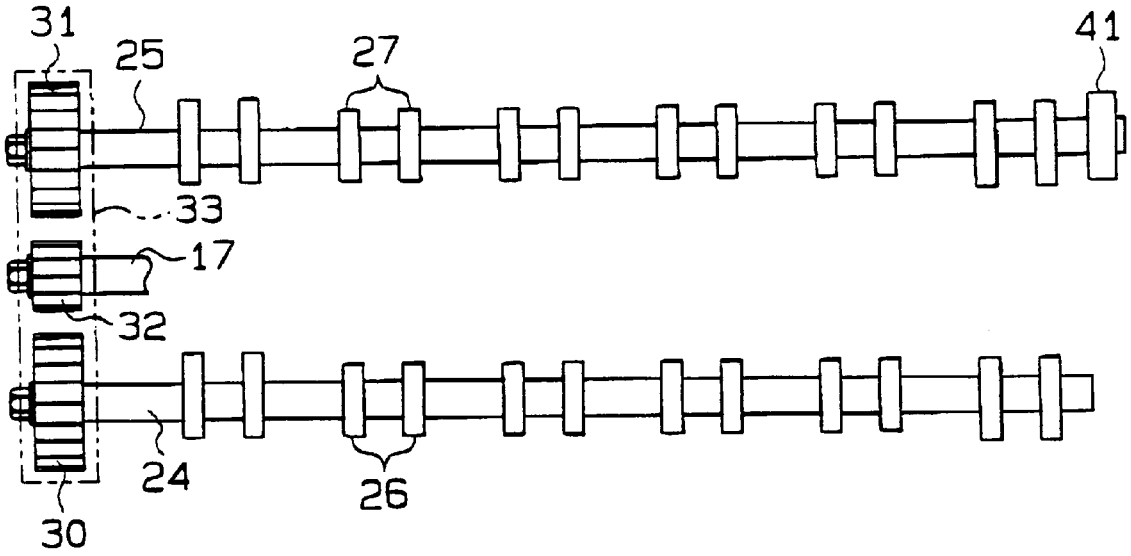
FIG. 9 is a diagram showing a valve train according to a third embodiment.

As shown in FIG. 9, six pairs of valve cams 26 are located on the intake camshaft 24. Similarly, six pairs of valve cams 27 are formed on the exhaust camshaft 25. Cam pulleys 30, 31 are secured to ends of the intake and exhaust camshafts 24, 25 respectively. A timing belt 33 is wound about the cam pulleys 30, 31 and a crank pulley 32. An elliptic pump cam 41 is secured to the right end of the exhaust camshaft 25. As in the first embodiment, the pump cam 41 has two cam noses. Rotation of the pump cam 41 actuates a fuel injection pump 40 (see FIG. 2).

Figure 11:
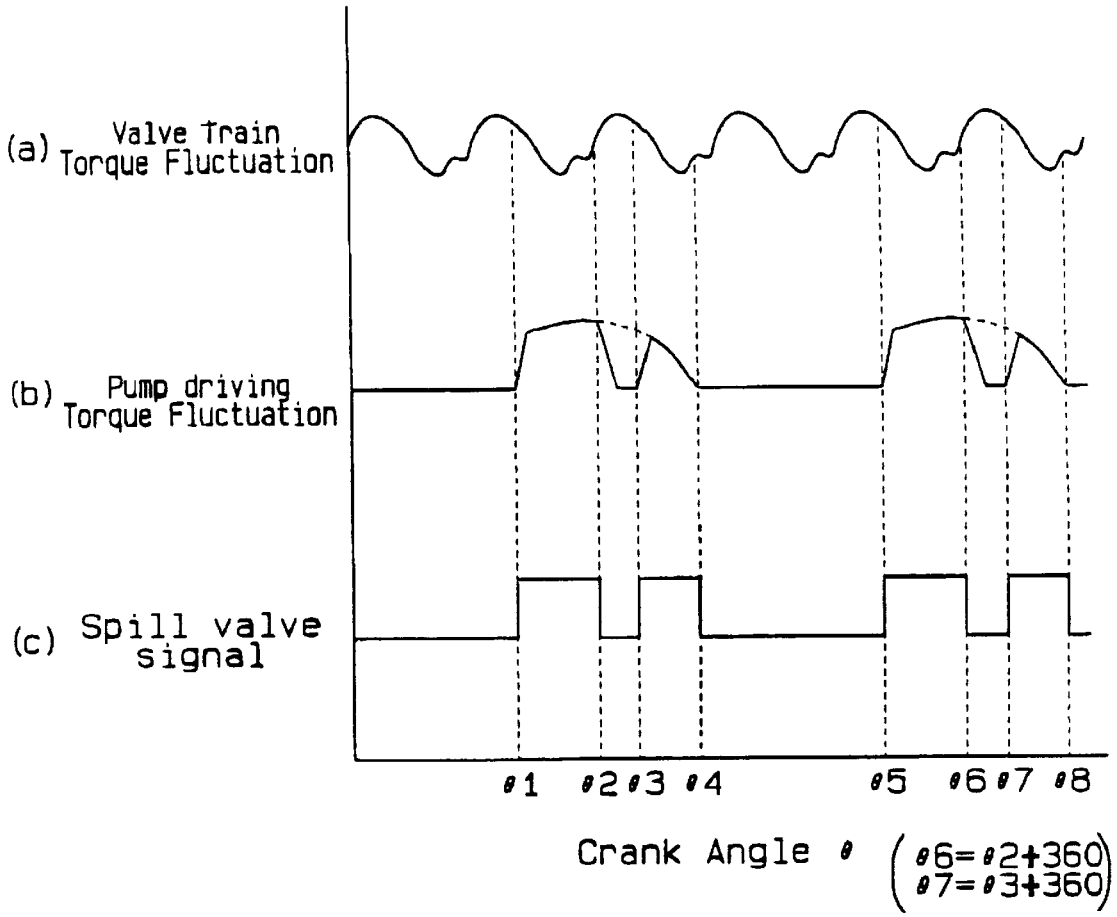
FIG. 11 is a graph showing the relationship between torque fluctuations and crank angle in the third embodiment.

Part (a) of FIG. 11 shows the valve train torque fluctuation (resultant of valve actuating torque fluctuations in the intake camshaft 24 and the exhaust camshaft 25) in relation to the crank angle θ. Part (b) shows the pump driving torque fluctuation in relation to the crank angle θ. Part (c) shows energizing signals output from the ECU 38 to the spill valve 57 in relation to the crank angle θ. In part (b) of FIG. 11, the continuous lines between crank angles θ2 and θ3 and between crank angles θ6 and θ7 represent pump driving torque fluctuation when a spill valve control routine, which will be described later, is being performed. The broken lines represent pump driving torque fluctuation when the routine is not performed.

When the camshafts 24, 25 have six pairs of the valve cams 26, 27, respectively, as in this embodiment, the valve train torque fluctuation has a relatively high frequency as illustrated in FIG. 11. During two turns of the crankshaft 17, the same waveform is repeated six times in the valve train torque fluctuation. In this case, greater values of the pump driving torque fluctuation overlap greater values of the valve train torque fluctuation (for example, between the crank angles θ2 and θ3). This increases the total torque fluctuation.

In this embodiment, the spill valve 57 is controlled to suppress the pump driving torque fluctuation. Accordingly, the total torque fluctuation, which is the resultant of the pump driving torque fluctuation and the valve train torque fluctuation, is decreased.

Figure 10:
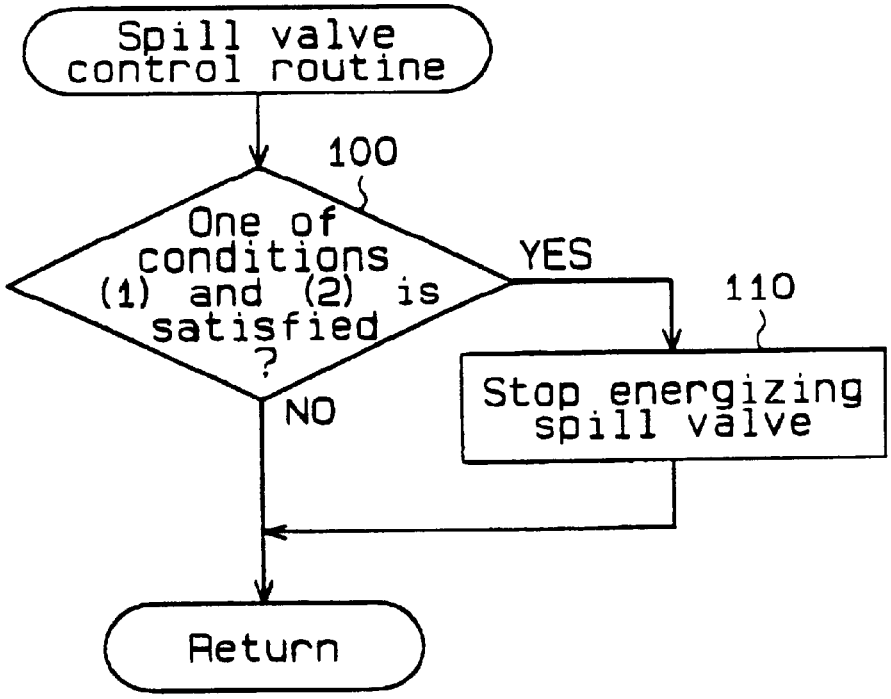
FIG. 10 is a flowchart showing a routine for controlling a spill valve.

The spill valve control routine for controlling the spill valve 57 will now be described referring to a flowchart of FIG. 10. As shown in part (*c*) of FIG. 11, current supply to the spill valve 57 is stated at a crank angle θ1 and at a crank angle θ5, and is stopped at crank angles θ4 and θ8. These times, at which current supply is started and stopped, are determined in a routine for controlling the fuel pressure in the fuel distribution pipe 22 (see FIG. 2). The spill valve control routine is an interrupt executed by the ECU 38 at every predetermined crank angle θ (for example, of 10 degrees).

At step 100, the ECU 38 judges whether the current crank angle θ satisfies one of the following conditions.

Condition (1): $\theta 2 \leqq \theta \leqq \theta 3$

Condition (2): $\theta 6 \leqq \theta \leqq \theta 7$ ($\theta 6 = \theta 2 + 360°$, $\theta 7 = \theta 3 + 360°$)

Ranges of crank angles θ at which the valve train torque fluctuation has greater values are previously computed. The minimum crank angle and the maximum crank angle in the computed range are defined as a first determination crank angle θ2 and a second determination crank angle θ3. The angles θ2 and θ3 are previously stored in a ROM of the ECU 38.

If one of the conditions (1) and (2) is satisfied at step 100, the ECU 38 moves to step 110. At step 110, the ECU 38 stops feeding current to the spill valve 57 thereby opening the spill valve 57. Then, fuel in the pressurizing chamber 45 (see FIG. 2) is returned to the fuel tank 52 (see FIG. 2) through the spill passage 56 (see FIG. 2). Since, pressurizing of fuel in the chamber 45 is temporarily stopped, the pump driving torque fluctuation is decreased substantially to zero in the ranges between θ2 and θ3 and between θ6 and θ7 as illustrated in the part (b) of FIG. 11.

If neither of the conditions (1) and (2) is satisfied at step 100, the ECU 38 temporarily suspends the routine. The ECU 38 also suspends the routine when finishing step 110.

As described above, current to the spill valve 57 is stopped at the ranges of crank angle θ in which the values of the valve train torque fluctuation is relatively great ($\theta 2 \leqq \theta \leqq \theta 3$, $\theta 6 \leqq \theta \leqq \theta 7$). This decreases pump driving torque fluctuation as illustrated by the continuous line in the part (b) of FIG. 11. Therefore, the valve train torque fluctuation is not augmented by the pump driving torque fluctuation. Accordingly, the maximum tension of the timing belt 33 and its tension fluctuation are decreased. As a result, the life of the belt 33 is extended.

A further embodiment of the present invention will now be described referring to FIGS. 12 to 16. In this embodiment, the present invention is embodied in an in-line four cylinder type engine 11.

Figure 12:
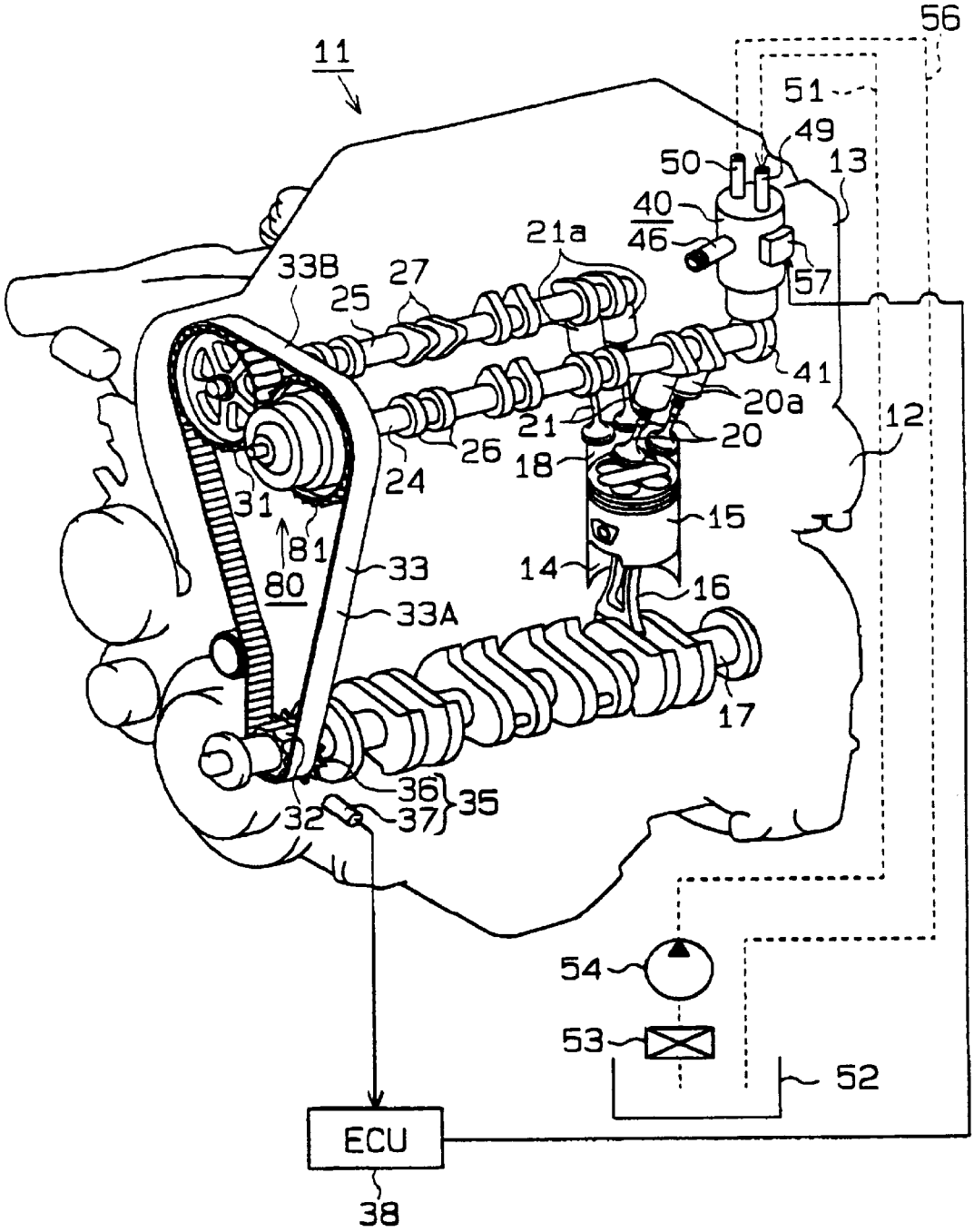
FIG. 12 is a partial perspective view illustrating an engine according to a fourth embodiment of the present invention.

As shown in FIG. 12, this embodiment is different from the first embodiment in that a pump cam 41 for actuating a fuel injection pump 40 is located on an intake camshaft 24 and in that a variable valve timing mechanism (VVT mechanism) 80 is provided on the intake camshaft 24. The VVT mechanism 80 changes the rotational phase of the shaft 24.

The VVT mechanism 80 includes a cam pulley 81 and a ring gear (not shown) located on an end (left side as viewed in FIG. 12) of the intake camshaft 24. The ring gear is located between the camshaft 24 and the pulley 81 for changing the rotational phased of the camshaft 24. The ring gear has helical teeth and is meshed with the cam pulley 81 and the intake camshaft 24. The ring gear is hydraulically moved in the axial direction of the intake camshaft 24. The axial movement of the ring gear changes the rotational phase of the camshaft 24 with respect to the cam pulley 81. The ECU 38 controls an oil control valve (not shown) for changing hydraulic pressure supplied to the ring gear thereby changing the rotational phase of the camshaft 24. Accordingly, the valve timing of the intake valves 20 is controlled.

Rotational force of the crankshaft 17 is transmitted to the camshafts 24, 25 by the timing belt 33. In this case, the tension of the belt 33 is greater in a part closer to the crankshaft 17 along the path of the belt 33. That is, the tension of the belt 33 is greatest at a first part 33A between the crank pulley 32 and the intake camshaft 24. A second part 33B between the cam pulleys 81 and 31 has the second greatest tension.

Figure 13A:
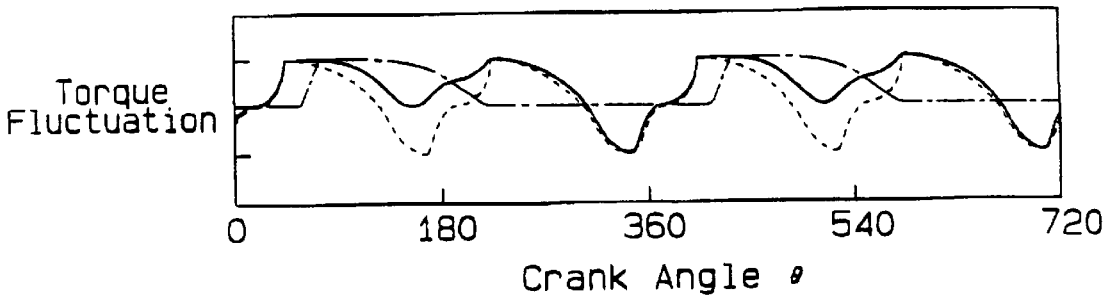
FIGS. 13(*a*), 13(*b*) and 13(*c*) are graphs showing the relationship between torque fluctuations in the intake camshaft and crank angle in the fourth embodiment.
Figure 13B:
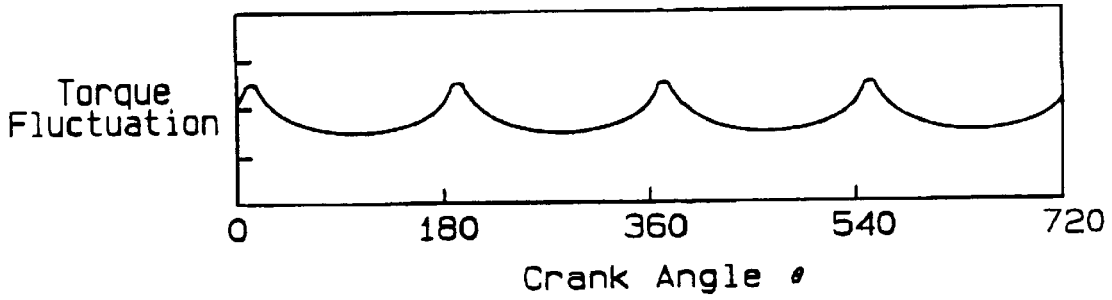
Figure 13C:
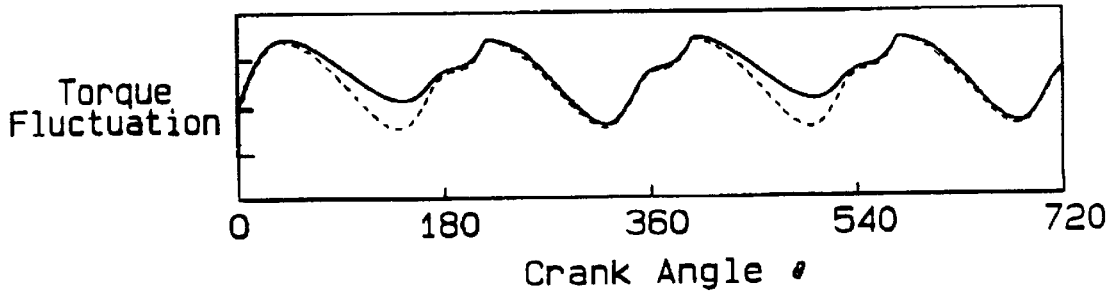

FIG. 13(*a*) is a graph showing the torque fluctuations in the intake camshaft 24 in relation to the crank angle θ. The uniformly broken line represents the valve actuating torque fluctuation. The long and short dashed line represents the pump driving torque fluctuation. The continuous line represents the resultant of the valve actuating torque fluctuation and the pump driving torque fluctuation in the camshaft 24. The continuous line in FIG. 13(*b*) represents the torque fluctuation in the crankshaft 17 caused by combustion in the combustion chambers 18. In FIG. 13(*c*), the continuous line represents the resultant of the resultant torque fluctuation (the continuous line in FIG. 13(*a*)) in the intake camshaft 24 and the crankshaft torque fluctuation (the continuous line in FIG. 13(*b*)). The resultant (the continuous line in FIG. 13(*c*)) causes the tension fluctuations in the first part 33A of the timing belt 33. In FIG. 13(*c*), the broken line represents the resultant of the valve actuating torque fluctuation (the uniformly broken line in FIG. 13(*a*)) of the camshaft 24 and the crankshaft torque fluctuation (the continuous line in FIG. 13(*b*)).

Figure 14A:
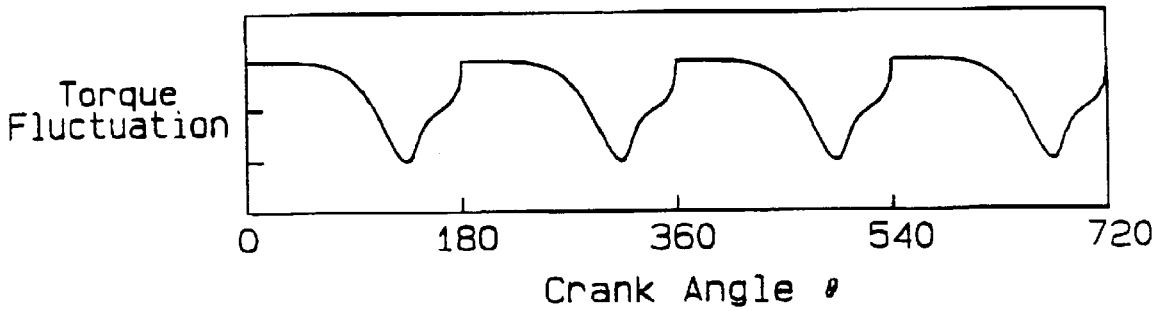
FIGS. 14(*a*) and 14(*b*) are graphs showing the relationship between torque fluctuations in the exhaust camshaft and crank angle.
Figure 14B:
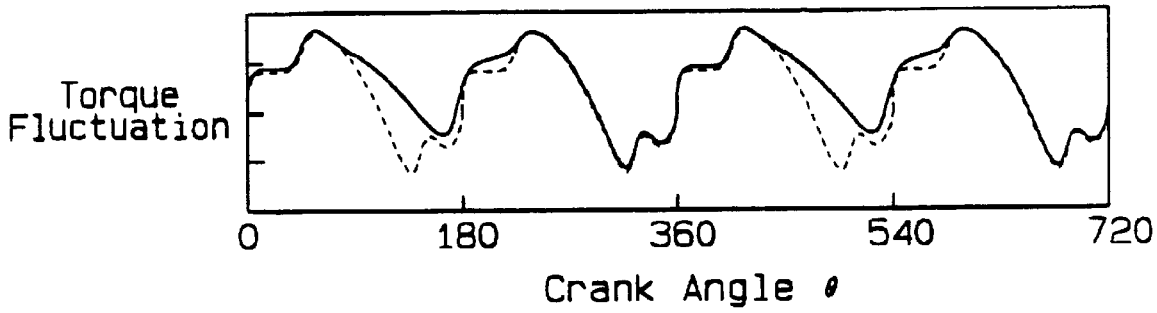

The continuous line of FIG. 14(*a*) represents the valve actuating torque fluctuation of the exhaust camshaft 25. The continuous line of FIG. 14(*b*) represents the total of the resultant torque fluctuation in the intake camshaft 24 (the continuous line in FIG. 13(*a*)) and the valve fluctuating torque fluctuation of the exhaust camshaft 25 (the continuous line in FIG. 14(*a*)). This total torque fluctuation (the continuous line in FIG. 14(*b*)) causes the tension fluctuation in the second part 33B of the timing belt 33. The broken line in the graph of FIG. 14(*b*) represents the resultant of the valve actuating torque fluctuation in the intake camshaft 24 (the uniformly broken line in FIG. 13(*a*)) and the valve actuating torque fluctuation in the exhaust camshaft 25 (the continuous line in FIG. 14(*a*)). This resultant (the broken line in FIG. 14(*b*)) is the valve train torque fluctuation of the engine 11.

As illustrated in FIG. 13(*a*), the phase of the pump cam 41, or the relative locations of the cam noses, is such that greater values of the pump driving torque fluctuation (the long and short dashed line in FIG. 13(*a*)) substantially overlap smaller values of the valve actuating torque fluctuation (the uniformly broken line in FIG. 13(*a*)) of the intake camshaft 24. As a result, the pump driving torque fluctuation (the long and short dashed line in FIG. 13(*a*)) of the intake camshaft 24 counteracts the resultant (the broken line in FIG. 13(*c*)) of the valve actuating torque fluctuation in the intake camshaft 24 (the uniformly broken line in FIG. 13(*a*)) and the torque fluctuation in the crankshaft 17 (the continuous line in FIG. 13(*b*)). The pump driving torque fluctuation (the long and short dashed line in FIG. 13(*a*)) also counteracts the valve train torque fluctuation (the broken line in FIG. 14(*b*)). Therefore, the amplitudes of the resultant torque fluctuations acting on the first part 33A and the second part 33B of the timing belt 33 are decreased as illustrated by the continuous lines in FIGS. 13(*c*) and 14(*b*).

Therefore, the amplitude of the tension fluctuation in the first part 33A and the second part 33B, in which tension is relatively high, is reduced. This extends the life of the timing belt 33.

The rotational phase of the intake camshaft 24 is changed by the VVT mechanism 80. Changes in the rotational phase of the intake camshaft 24 change the phase of the valve train torque fluctuation in relation to the phase of the pump driving torque fluctuation. This may augment the valve train torque fluctuation with the pump driving torque fluctuation. In other words, the magnitude of the combination of the valve train torque fluctuation and the pump driving torque fluctuation may be increased.

Figure 15A:
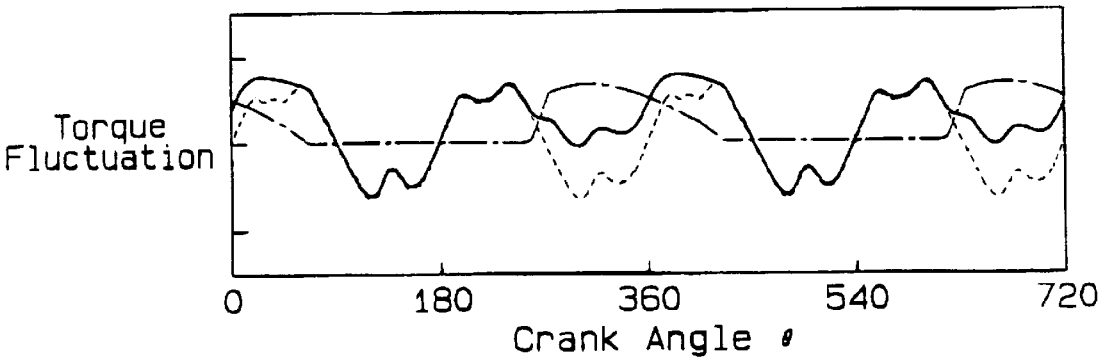
FIGS. 15(*a*), 15(*b*) and 15(*c*) are graphs showing the relationship between torque fluctuations and crank angle when the rotational phase of the intake camshaft is changed by a variable valve timing mechanism.
Figure 15B:
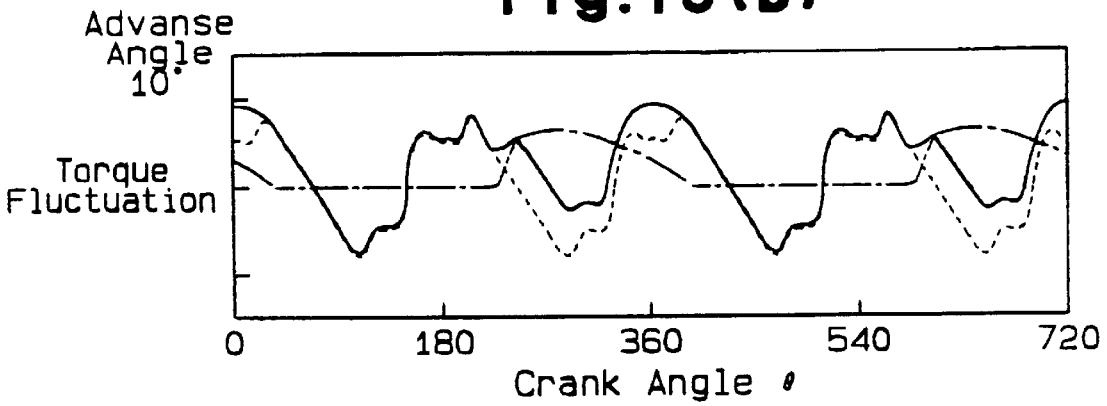
Figure 15C:
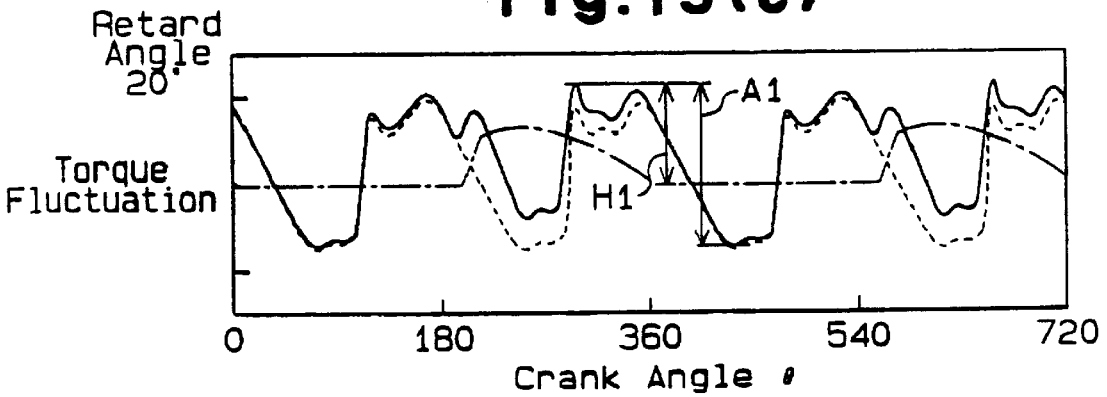

FIG. 15(*a*) is a graph showing the valve train torque fluctuation (the resultant of the valve actuating torque fluctuation in the camshafts 24, 25), the pump driving torque fluctuation and the total torque fluctuation, which is resultant of the valve train torque fluctuation and the pump driving torque fluctuation in relation to the crank angle θ. The uniformly broken line represents the valve train torque fluctuation. The long and short dashed line represents the pump driving torque fluctuation. The continuous line represents the total torque fluctuation. FIGS. 15(*b*) and 15(*c*) show the valve train fluctuation, the pump driving fluctuation and the total torque fluctuation when the rotational phase of the intake camshaft 24 is advanced by the VVT mechanism 80. In FIG. 15(*b*), the rotational phase of the camshaft 24 is advanced by 10°. In FIGS. 15(*c*), the rotational phase of the camshaft 24 is advanced by 20°.

Figure 16A:
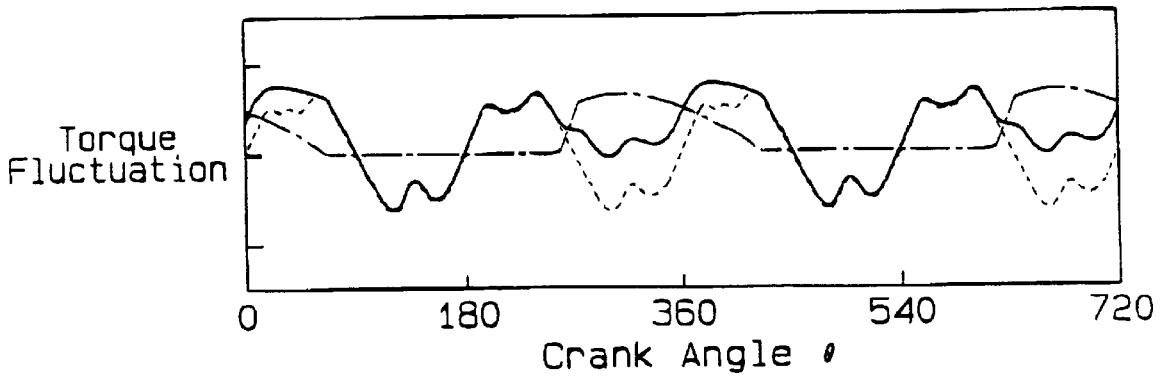
FIGS. 16(*a*), 16(*b*) and 16(*c*) are graphs showing the relationship between torque fluctuations in the intake camshaft and crank angle in a comparison example when the rotational phase of the intake camshaft is changed.
Figure 16B:
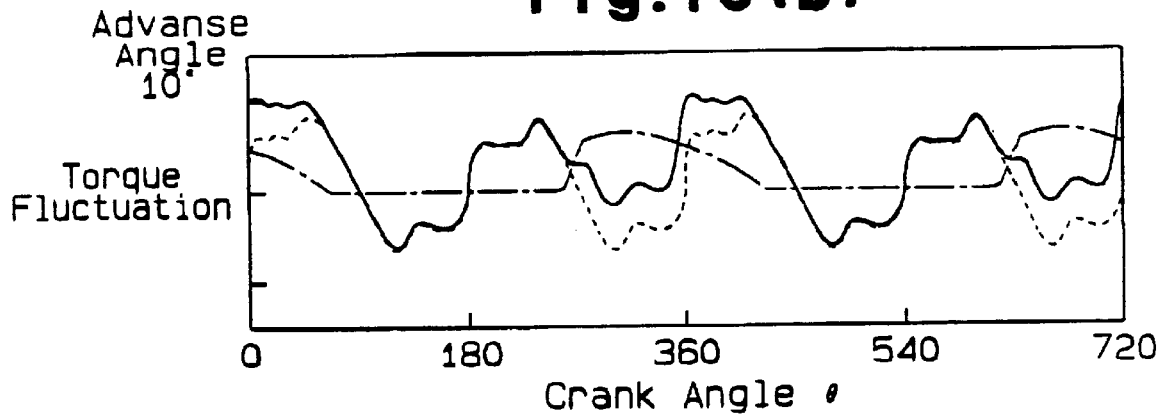
Figure 16C:
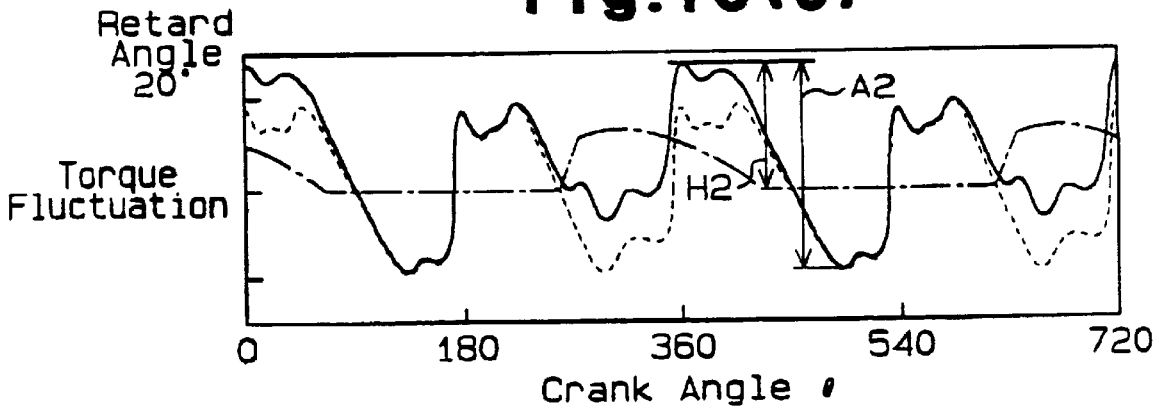

FIG. 16(*a*) is a graph of a comparison example. In this example, the pump cam 41 is located on the exhaust camshaft 25, the rotational phase of which is not changed. In FIG. 16(*a*), the uniformly broken line represents the valve train torque fluctuation. The long and short dashed line represents the pump driving torque fluctuation. The continuous line represents the total torque fluctuation. FIGS. 16(*b*) and 16(*c*) show the valve train fluctuation, the pump driving fluctuation and the total torque fluctuation of the comparison example when the rotational phase of the intake camshaft 24 is advanced by the VVT mechanism 80. In FIGS. 16(*b*), the rotational phase of the camshaft 24 is advanced by 10°. In FIG. 16(*c*), the rotational phase of the camshaft 24 is advanced by 20°.

In the comparison example of FIGS. 16(*a*)–16(*b*), the pump cam 41 is located on the exhaust camshaft 25. In this case, changes in the rotational phase of the intake camshaft 24 gradually cause greater values of the valve train torque fluctuation to overlap the greater value of the pump driving torque fluctuation. As a result, the maximum value H2 and the maximum amplitude A2 of the total torque fluctuation (the continuous line in FIG. 16(*c*)) are increased.

Contrarily, in the embodiment of FIGS. 15(*a*)–15(*c*), the phase of the pump driving torque fluctuation is changed as the rotational phase of the intake camshaft 24 is changed. Therefore, the maximum value H1 and the maximum amplitude A1 of the total torque fluctuation (the continuous line in FIG. 15(*c*)) are smaller than the maximum value H2 and the maximum amplitude A2 of the comparison fluctuation of FIG. 16(*c*).

As described above, this embodiment prevents the total torque fluctuation (the continuous line in FIG. 15(*c*)) from being increased when the rotational phase of the intake camshaft 24 is changed by the VVT mechanism 80.

In this embodiment, the VVT mechanism 80 may be provided on the exhaust camshaft 25 for changing the valve timing of the exhaust valves 21. Alternatively, the rotational phase of the exhaust camshaft 25 may be changed by the VVT mechanism 80 located on the intake camshaft 24 for changing the valve timing of the exhaust valves 21. In this case, the pump cam 14 is located on the exhaust camshaft 25.

In this embodiment, the VVT mechanism 80 may be any type of VVT mechanism as long as it changes the rotational phase of the intake channel 24 or the rotational phase of the exhaust camshaft 25 may be changed by the VVT mechanism 80 located on the intake camshaft 24 for changing the valve timing of the exhaust valves 21. In this case, the pump cam 41 is located on the exhaust camshaft 25.

In this embodiment, the VVT mechanism 80 may be any type of VVT mechanism as long as it changes the rotational phase of the intake camshaft 24 or the rotational phase of the exhaust camshaft 25. For example, instead of the ring gear type VVT mechanism 80, a vane type VVT mechanism may be used. In this case, a vane body having vanes is secured on the intake camshaft 24. Two pressure chambers are defined on both sides of each vane body by a cam pulley. The vane body is rotated by changing hydraulic pressure communicated with the pressure chambers. Accordingly, the rotational phase of the intake camshaft 24 (the rotational phase of the exhaust camshaft 25) is changed.

It should be apparent to those skilled in the art that the present invention may be embodied in many other specific forms without departing from the spirit or scope of the invention. Particularly, it should be understood that the invention may be embodied in the following forms.

(1) The pulleys 30, 31, 32, 81 and the timing belt 33 may be replaced with sprockets and a timing chain. Alternatively, the rotational force of the crankshaft 17 may be transmitted to the camshafts 24, 25 (62, 63, 66, 67) by gears. In these cases, the present invention reduces the tension of the timing chain or the load acting on the gears thereby improving the longevity of the chain and the gears.

(2) In the illustrated embodiments, the present invention is embodied in the engines 11 of in-line four cylinder type, six-cylinder V-type and in-line six cylinder type. However, the present invention may be embodied in engines having more cylinders.

(3) In the third embodiment, the pump cam 41 may be located on the intake camshaft 24. In this case, the valve driving fluctuation of the intake camshaft 24 is reduced by controlling the spill valve 57. As in the fourth embodiment, this construction reduces tension fluctuation in the first part 33A and the second part 33B, at which the tension is relatively high.

Figure 17:
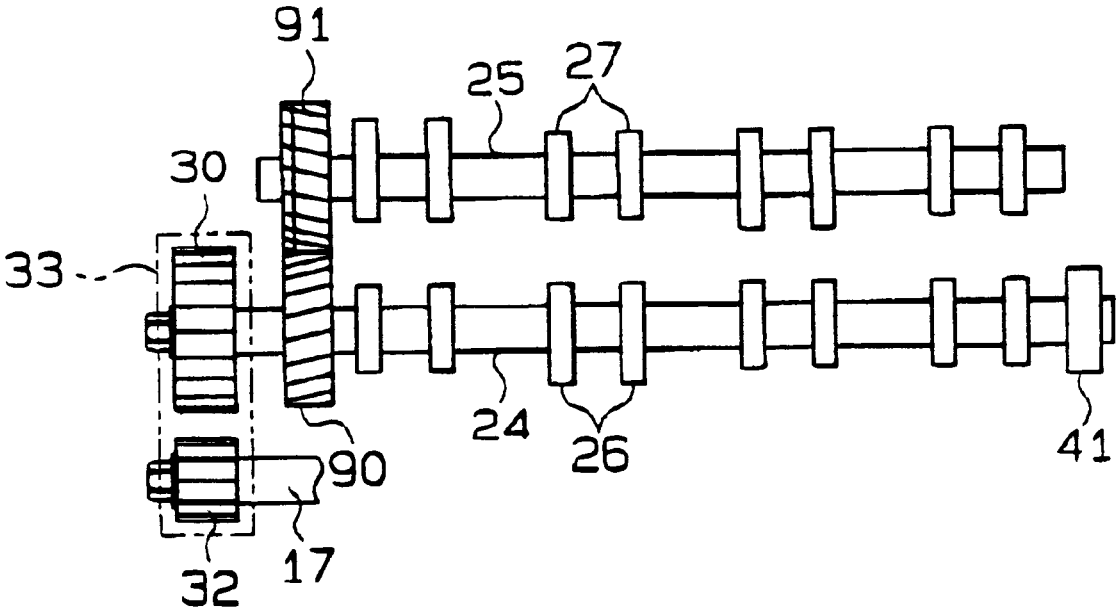
FIG. 17 is a diagram illustrating a valve train according to another embodiment of the present invention.

(4) In the first embodiment, the cam pulleys 30, 31, which are secured to the camshafts 24, 25, respectively, are connected to the crank pulley 32 by the timing belt 33. However, a construction illustrated in FIG. 17 may be used. In this construction, the cam pulley 30 is secured to the left end of the intake camshaft 24 and connected to the crank pulley 32 by the timing belt 33. A driver gear 90 is located on the intake camshaft 24. The driver gear 90 is meshed with a driven gear 91 provided on the exhaust camshaft 25. Since the driver gear 90 and the driven gear 91 may rattle, a pump cam 41 is preferably located on the right end of the intake camshaft 24 for using the pump driving torque fluctuation to reduce the tension fluctuation of the timing belt 33.

(5) In the fourth embodiment, the spill valve 57 may be controlled in the manner illustrated in the third embodiment. In this case, the opening timing of the spill valve 57 is changed as the phase of the camshaft 24 is changed.

Therefore, the present examples and embodiments are to be considered as illustrative and not restrictive and the invention is not to be limited to the details given herein, but may be modified within the scope and equivalence of the appended claims.

What is claimed is:

1. A valve train for driving an engine valve in an internal combustion engine, the valve train comprising:

a camshaft;

a crankshaft;

a pump for supplying fuel in a reservoir to the engine, wherein the pump has a pressure chamber for compressing fuel;

a valve cam provided on the camshaft for selectively opening and closing the engine valve, wherein the camshaft has a first torque fluctuation cycle that corresponds to the rotation of the crankshaft as a result of driving the engine valve;

a pump cam provided on the camshaft for driving the pump, wherein the camshaft has a second torque fluctuation cycle that corresponds to the rotation of the crankshaft as a result of compressing fuel by the pump; and a transmission mechanism for transmitting the torque of the crankshaft to the camshaft, wherein the pump cam has a phase with respect to the camshaft to reduce a composite of the first and second torque fluctuation cycles.

2. The valve train according to claim 1, wherein the pump cam has a phase such that the torque generated in the camshaft by the pump is relatively small when the torque generated in the camshaft by the engine valve is relatively large.

3. The valve train according to claim 2, further comprising:

a spill passage connected to the pressure chamber for returning fuel to the reservoir;

a control valve positioned in the spill passage; and a controller for selectively opening and closing the control valve to reduce the composite of the first and second torque fluctuation cycle.

4. The valve train according to claim 3, wherein substantially no torque fluctuation is generated in the camshaft by the pump when the control valve opens the spill passage, and the controller opens the control valve when the torque generated in the camshaft by the engine valve is relatively large.

5. The valve train according to claim 4, wherein the engine is a four cycle engine, and the pump cam has two cam noses.

6. The valve train according to claim 1, wherein the camshaft is a first camshaft; wherein the valve train further comprises a second camshaft for driving another engine valve; wherein the transmission mechanism includes a flexible element for connecting the crankshaft to the first and second camshafts; wherein the flexible element is tensioned by the torque of the crankshaft; wherein the flexible element follows a path and a section of the path lies directly between the crankshaft and one of the first and second camshafts; and wherein the tension in the flexible element is higher in the section than in other parts of the path.

7. The valve train according to claim 6, further comprising a valve adjuster positioned on one of the first and second camshafts for changing the phase relationship between the crankshaft and the one of the first and second camshafts.

8. The valve train according to claim 7, wherein the valve adjuster changes the rotational relationship between the crankshaft and the pump cam.

9. The valve train according to claim 7, wherein the engine is a V-type engine having two banks; wherein one bank accommodates the first and second camshafts; and the other bank accommodates an additional pair of camshafts; and wherein the transmission mechanism includes a flexible element for connecting the crankshaft to one of the camshafts in each bank.

10. The valve train according to claim 9, wherein the engine is a four cycle engine having three cylinders in each bank, and the pump cam has three cam noses.

11. A valve train for driving an engine valve in an internal combustion engine, the valve train comprising:

a camshaft;

a crankshaft;

a pump for supplying fuel in a reservoir to the engine, wherein the pump has pressure chamber for compressing fuel;

a valve cam provided on the camshaft for selectively opening and closing the engine valve, wherein the camshaft has a first torque fluctuation cycle that corresponds to the rotation of the crankshaft as a result of driving the engine valve;

a pump cam provided on the camshaft for driving the pump, wherein the camshaft has a second torque fluctuation cycle that corresponds to the rotation of the crankshaft as a result of compressing fuel by the pump;

a transmission mechanism for transmitting the torque of the crankshaft to the camshaft;

a spill passage connected to the pressure chamber for returning fuel to the reservoir;

a control valve positioned in the spill passage, wherein the pump compresses fuel only when the control valve is closed; and a controller for selectively opening and closing the control valve to reduce the composite of the first and second torque fluctuation cycles.

12. The valve train according to claim 11, wherein the controller opens the valve to stop the fuel compression when the torque generated in the camshaft by the engine valve is relatively large.

13. The valve train according to claim 12, wherein the camshaft is a first camshaft, the valve train further comprises a second camshaft for driving another engine valve and the transmission mechanism includes a flexible element for connecting the crankshaft to the first and second camshafts.

14. The valve train according to claim 13, further comprising a valve adjuster positioned on one of the first and second camshafts for changing the phase relationship between the crankshaft and one of the first and second camshafts.

15. The valve train according to claim 14, wherein the valve adjuster changes the rotational relationship between the crankshaft and the pump cam.

* * * * *